US011906220B2

(12) United States Patent
Benack et al.

(10) Patent No.: US 11,906,220 B2
(45) Date of Patent: Feb. 20, 2024

(54) INJECTOR SYSTEM FOR REFRIGERANT SYSTEMS

(71) Applicant: Nu-Calgon Wholesaler, Inc., St. Louis, MO (US)

(72) Inventors: Michael Benack, St. Louis, MO (US); Doug Gildehaus, St. Louis, MO (US)

(73) Assignee: Nu-Calgon Wholesaler, Inc., Maryland Heights, MO (US)

( * ) Notice: Subject to any disclaimer, the term of this patent is extended or adjusted under 35 U.S.C. 154(b) by 116 days.

(21) Appl. No.: 17/391,565

(22) Filed: Aug. 2, 2021

(65) Prior Publication Data

US 2022/0260291 A1 Aug. 18, 2022

Related U.S. Application Data

(60) Provisional application No. 63/060,397, filed on Aug. 3, 2020.

(51) Int. Cl.
*F25B 45/00* (2006.01)
*F25B 47/00* (2006.01)

(52) U.S. Cl.
CPC ..... *F25B 45/00* (2013.01); *F25B 47/00* (2013.01); *F25B 2345/004* (2013.01)

(58) Field of Classification Search
CPC .... F25B 47/00; F25B 45/00; F25B 2345/004; B60H 1/00585
See application file for complete search history.

(56) References Cited

U.S. PATENT DOCUMENTS

| | | | | |
|---|---|---|---|---|
| 5,996,651 | A * | 12/1999 | Scaringe | F25B 45/00 141/4 |
| 6,155,066 | A | 12/2000 | Chandler et al. | |
| 6,308,528 | B2 | 10/2001 | Knowles | |
| 6,439,274 | B1 * | 8/2002 | DeBoisblanc | F25B 45/00 141/94 |
| 2004/0112443 | A1 | 6/2004 | Knowles et al. | |
| 2004/0123617 | A1 | 7/2004 | Knowles | |
| 2005/0081914 | A1 | 4/2005 | Kalley et al. | |

FOREIGN PATENT DOCUMENTS

| | | | | |
|---|---|---|---|---|
| CA | 2211898 C | * | 4/2006 | F25B 45/00 |
| WO | 2015135081 A1 | | 9/2015 | |

* cited by examiner

*Primary Examiner* — Frantz F Jules
*Assistant Examiner* — Martha Tadesse
(74) *Attorney, Agent, or Firm* — STINSON LLP

(57) ABSTRACT

An injector for servicing a refrigerant system employs a reconfigurable container that is selectively configurable in a plurality of different container configurations. In each container configuration, an outlet of the reconfigurable container can be fluidly connected to the refrigerant system such that the injector can discharge treatment fluid through the outlet into the refrigerant system. The plurality of different container configurations can include a plurality of different fillable container configurations or one or more fillable container configurations and a pass-through configuration. In a fillable container configuration, the reconfigurable container defines a fillable space for receiving treatment fluid. In a pass-through container configuration, the reconfigurable container passes fluid from a disposable container through the outlet. In use, the desired container configuration is selected and fluid is injected from the injector into a refrigerant system.

17 Claims, 9 Drawing Sheets

INJECTOR SYSTEM FOR REFRIGERANT SYSTEMS

CROSS-REFERENCE TO RELATED APPLICATION

This application claims priority to U.S. Provisional Patent Application No. 63/060,397, filed Aug. 3, 2020, and entitled INJECTOR SYSTEM FOR REFRIGERANT SYSTEMS, which is hereby incorporated by reference in its entirety for all purposes.

FIELD

The present disclosure generally pertains to an injector of the type used to impart chemical treatments into a building's heating, ventilation and air conditioning (HVAC) system, commercial refrigeration systems, or other types of refrigerant systems.

BACKGROUND

Two injector systems for injecting chemical treatments into refrigerant systems are in wide use in the HVAC and commercial refrigeration repair/maintenance industries. The first type of injector system uses a refillable container to deliver the desired treatment fluid, and the second type of injector system uses a disposable container to deliver the treatment fluid. Each type of injector system functions essentially the same way. An inlet fitting on one end of the container is connected to the high pressure service fitting of the refrigerant system via a manifold gauge set, and an outlet fitting is connected to the low pressure service fitting via an injector hose. A valve on the injector hose is opened and the high pressure valve of the manifold gauge set is also opened as needed to drive the treatment fluid from the refillable or disposable container into the low-pressure side of the refrigerant system.

SUMMARY

In one aspect, an injector for servicing a refrigerant system comprises a reconfigurable container having an outlet. The reconfigurable container is selectively configurable in either of a first container configuration and a second container configuration different than the first container configuration. In each of the first container configuration and the second container configuration the outlet of the reconfigurable container is configured to be fluidly connected to the refrigerant system such that the injector can discharge treatment fluid through the outlet into the refrigerant system.

In another aspect, a method of servicing a refrigerant system by injecting treatment fluid into the refrigerant system comprises determining a type of treatment fluid to be used. A reconfigurable container of a refrigerant system injector is configured in a selected one of a plurality of selectable container configurations appropriate for the type of treatment fluid to be used. The treatment fluid is injected into the refrigerant system from an outlet of the reconfigurable container configured in the selected one of the plurality of selectable container configurations.

Other aspects and features will be apparent hereinafter.

BRIEF DESCRIPTION OF THE DRAWINGS

Corresponding reference characters indicate corresponding parts throughout the drawings.

DETAILED DESCRIPTION

Figure 1:
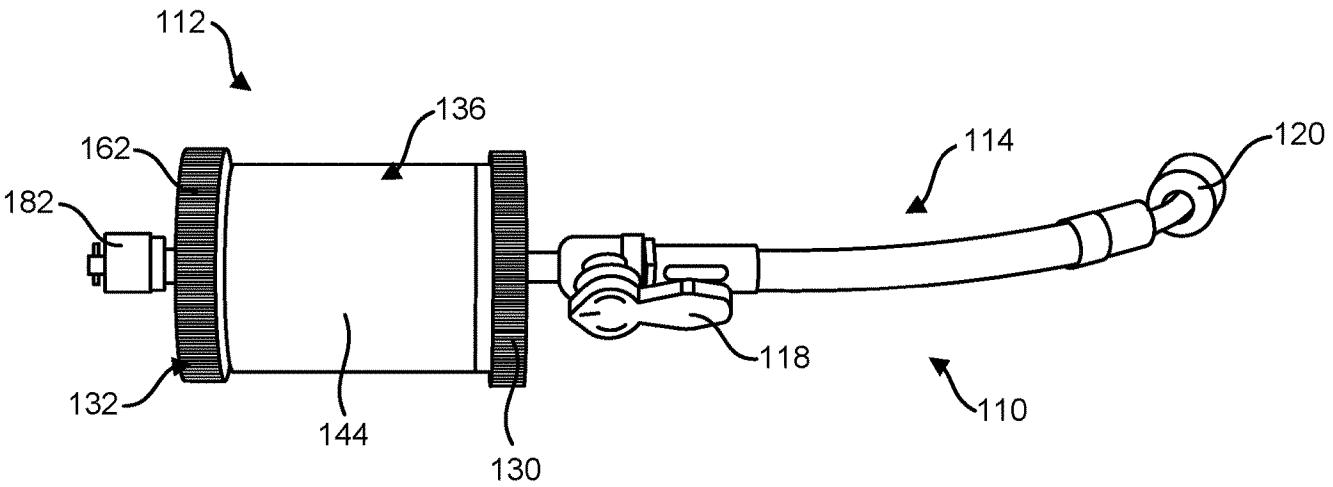
FIG. 1 is an elevation of an injector, depicting a reconfigurable container thereof in a small-volume fillable container configuration.

The present inventors have recognized several drawbacks to existing injector systems for servicing refrigerant systems. In the case of the refillable type, a problem arises when a volume of treatment fluid is required that differs from the fillable volume of the closed container. If the container volume is less than the required amount of treatment fluid, a technician must repeat the process of filling the injector and injecting the fluid more than one time. If the container volume is greater than the required amount of treatment fluid, the technician will inherently impart air into the container when filling. If the air in the container is not mitigated by pulling a vacuum in in the under-filled container, the air will be injected into to the refrigerant system along with the treatment fluid, which can adversely affect the refrigerant system. However, evacuating the air from the container requires additional equipment and increases the duration of the service call. Thus, proper refrigerant system servicing using refillable-type injector systems requires a service technician to carry multiple injector sizes and/or to carry a vacuum pump in addition to a large-volume refillable container injector. Disposable-type containers can have more expensive material costs per service application than refillable-type containers. Furthermore, even disposable-type containers require additional dedicated equipment for use, specifically a dedicated valved injector hose. Moreover, some types of treatment fluids may be unavailable in a disposable container, which requires a service technician to carry different tools for both refillable container- and disposable container-based treatments. Accordingly, the inventors have recognized a need in the art for a single injector system that can function properly to inject different volumes of treatment fluid poured into the injector and/or that can also function to inject treatment fluid from disposable containers.

Referring now to FIGS. 1-16, an exemplary embodiment of an injector system in the scope of this disclosure is generally indicated at reference number 110. The injector system 110 generally comprises a reconfigurable container 112 and an outlet hose 114 coupled to an outlet 116 (FIG. 11) of the reconfigurable container. Similar to outlet hoses of conventional injector systems, the outlet hose 114 comprises one or more control valves 118 (e.g., ball valves) and a connection fitting 120 configured to fluidly couple the injector to a service fitting of a refrigerant system. (FIGS. 1-5 depict an exemplary injector system no with a single ball valve; FIGS. 6-16 depict the injector system no with dual ball valves; and still other valve configurations are possible without departing from the scope of the disclosure.) In general, the injector no is configured to operate by imparting treatment fluid through the outlet 116 and the outlet hose 114 to the refrigerant system. Various treatment fluids used in this manner are known or may become known to those skilled in the art. By way of example and not limitation, suitable treatment fluids in the scope of this disclosure include Rx-Acid Scavenger, A/C ReStart, and A/C Re-New treatment fluids, sold by the assignee of this disclosure. Additionally, it is known to use chemical treatments comprising ultraviolet dyes in certain refrigerant system servicing applications, which dyes are typically supplied in disposable containers. As explained more fully below, the injector system no is configured for injecting any suitable type of chemical treatment into a refrigerant system, whether supplied in a fillable product form or a disposable container form.

As will be explained in further detail below, the reconfigurable container 112 is selectively configurable in a plurality of different container configurations to suit particular servicing applications. For example, in one or embodiments, the reconfigurable container 112 is selectively configurable in container configurations of different fillable volumes. In certain embodiments, the reconfigurable container 112 is selectively configurable in a container configuration defining a fillable volume and another container configuration in which the container functions as a pass-through device for coupling another container (e.g., a disposable container) to the refrigerant system.

In the illustrated embodiment, the reconfigurable container 112 comprises an outlet end wall component 130 (broadly, an outlet component), a pair interchangeable inlet components 132, and a reconfigurable side wall assembly 136. In various configurations of the illustrated reconfigurable container 112, the container has a generally cylindrical shape in which the outlet end wall component 130 defines an outlet end wall of the container, an optional inlet wall component 132 defines an inlet end wall of the container that is spaced apart from the outlet end wall of the container along an axis A (FIGS. 5-11), and the reconfigurable side wall assembly 136 is assembled between the end walls to define a side wall that connects the outlet end wall to the inlet end wall and extends circumferentially about the axis from the outlet end wall to the inlet end wall.

In this disclosure, the terms "downstream" and "upstream" are used to connote directionality or relative position along the axis A. In particular, a "downstream direction" is one that extends generally along the axis A in the same direction that an outlet end wall or outlet fitting is spaced from an inlet end wall or inlet fitting along the axis. An element is considered "downstream" in relation to another component when the former is spaced apart from the latter in the downstream direction. Similarly, an "upstream direction" is one that extends generally along the axis A in the same direction that the inlet end wall or inlet fitting is spaced from the outlet end wall or outlet fitting along the axis. An element is considered "upstream" in relation to another component when the former is spaced apart from the latter in the upstream direction.

The outlet end wall component 130 comprises a wall member that has an inner (upstream) end and an outer (downstream) end spaced apart along the axis A. The outlet end wall component 130 includes a central opening that extends through the wall member from the inner end through the outer end to form the container outlet 116. In the illustrated embodiment, the outlet opening 116 is internally threaded. A fitting 140 is threadably received in the outer end portion of the outlet opening 116 to fluidly connect the outlet hose 114 to the outlet opening. In the illustrated embodiment, the outlet fitting 140 (FIG. 11) comprises a valve depressor 142 (broadly, a valve actuator) that is configured to open a valve threaded into the inner end portion of the outlet opening 116, as will be explained in further detail below.

The reconfigurable side wall assembly 136 is generally configured to be selectively assembled between the outlet end wall and the inlet end wall component 132 to form various configurations of a side wall having different lengths along the axis A between the outlet end wall and the inlet end wall. The reconfigurable side wall assembly 136 comprises a plurality of tubular side wall components 144, 146, 148 configured to be assembled end-to-end between the outlet end wall and the inlet end wall in a plurality of different side wall configurations of different lengths along the axis A. In general, each of the side wall components 144, 146, 148 comprises an annular wall that has a respective length along the axis A and is configured to extend 360 degrees circumferentially around the axis A. Furthermore, each side wall component 144, 146, 148 is configured to releasably connect to at least one of the other side wall components.

A first side wall component 144 is generally configured to connect to the outlet end wall component 130. In one or more embodiments, the first side wall component 144 can be connected to the outlet end wall component 130 in every one of the plurality of container configurations of the reconfigurable container 112. Thus, in FIG. 16, the first side wall component 144 is integrally formed with the outlet end wall component 130 from a single piece of monolithic material. Alternatively, in another embodiment depicted in FIGS. 1-15, the outlet end wall component 130 and the first side wall component 144 are formed from separate pieces of material that are configured to be releasably connected together. More particularly, in the illustrated embodiment, the outlet end wall component 130 and the first side wall component 144 are configured to couple together by a threaded connection. The inner (upstream) end portion of the illustrated outlet end wall component 130 is externally threaded, and the downstream end portion of the first side wall component 144 is internally threaded for threading onto the external threads of the outlet end wall component. A seal 150 (e.g., an O-ring gasket) is seated on the outlet end wall component at a location spaced apart along the axis A in the downstream direction from the external threads. The seal 150 is radially compressed between the outlet end wall component 130 and the first side wall component 144 when the first side wall component is threaded onto the outlet end wall component to form a fluid seal of the interface between the outlet end wall component and the first side wall component.

Each of the second side wall component 146 and the third side wall component 148 is configured to releasably connect to the first side wall component 144. In particular, each of the second side wall component 146 and the third side wall component 148 is configured to releasably connect to the first side wall component by a threaded connection. In the illustrated embodiment, each of the second side wall component 146 and the third side wall component 148 comprises an externally threaded downstream end portion and a respective seal 152, 154 (e.g., an O-ring gasket (FIGS. 12, 13, and 16)) is seated on the respective side wall component at a location spaced apart along the axis A from the external threads in the upstream direction. Each of the first side wall component 144, the second side wall component 146, and the third side wall component 148 further comprises an internally threaded upstream end portion. The externally threaded downstream end portions of the second and third side wall components 146, 148 are configured to be threadably connected to the internally threaded upstream end portion of either the first side wall component 144 or the other of the second and third side wall components. When a threaded connection is made, the respective seal 152, 154 is radially compressed between the respective side wall component 146, 148 on which it is disposed and the upstream end portion of the mated side wall component to form a fluid seal of the threaded interface.

Figure 2:
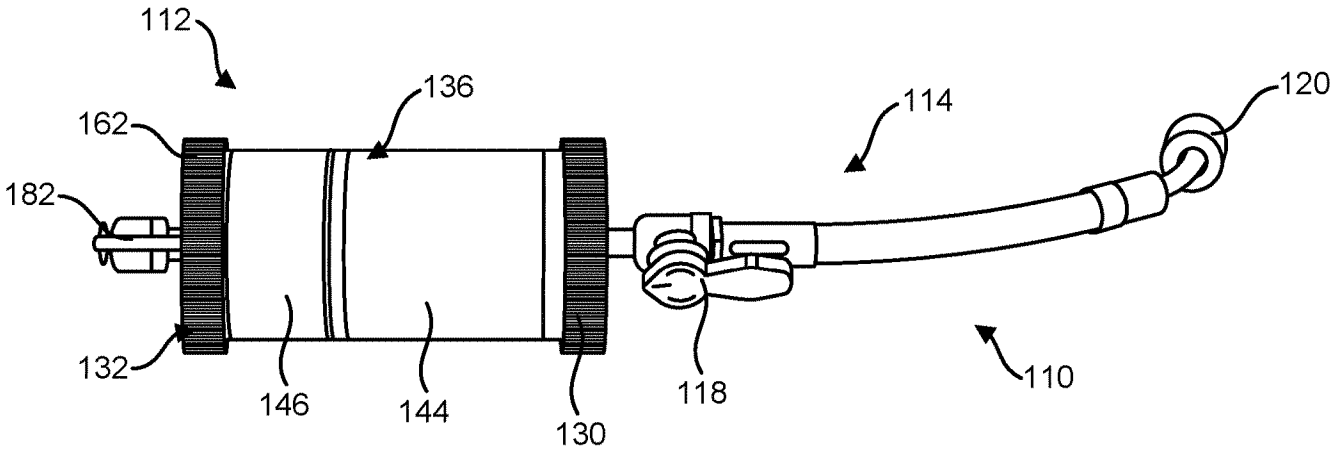
FIG. 2 is an elevation similar to FIG. 1, depicting the reconfigurable container in a first medium-volume fillable container configuration.
Figure 3:
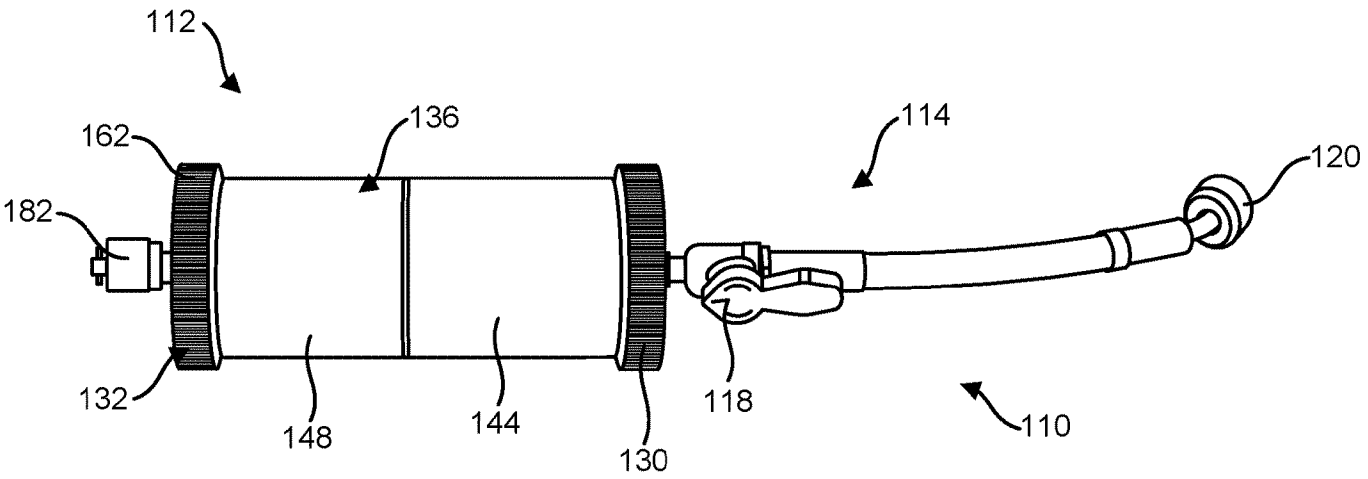
FIG. 3 is an elevation similar to FIG. 1, depicting the reconfigurable container in a second medium-volume fillable container configuration.
Figure 6:
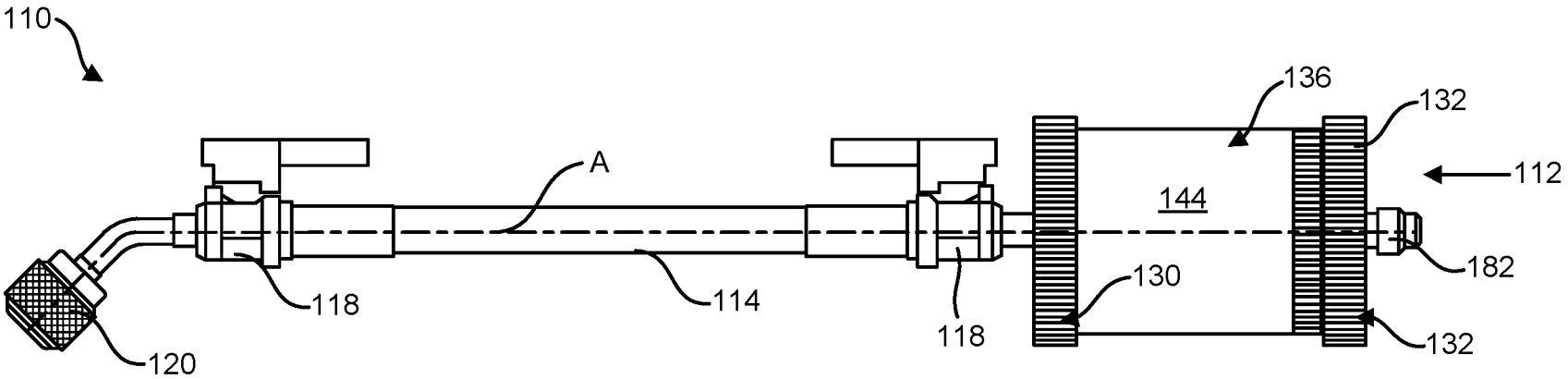
FIG. 6 is an elevation of an injector, depicting a reconfigurable container thereof in a small-volume fillable container configuration.
Figure 7:
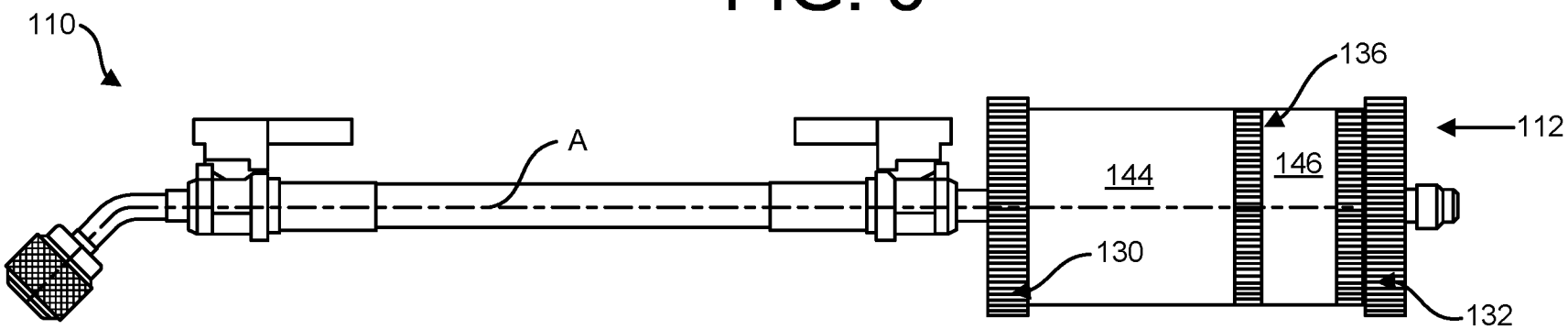
FIG. 7 is an elevation similar to FIG. 6, depicting the reconfigurable container in a first medium-volume fillable container configuration.
Figure 8:
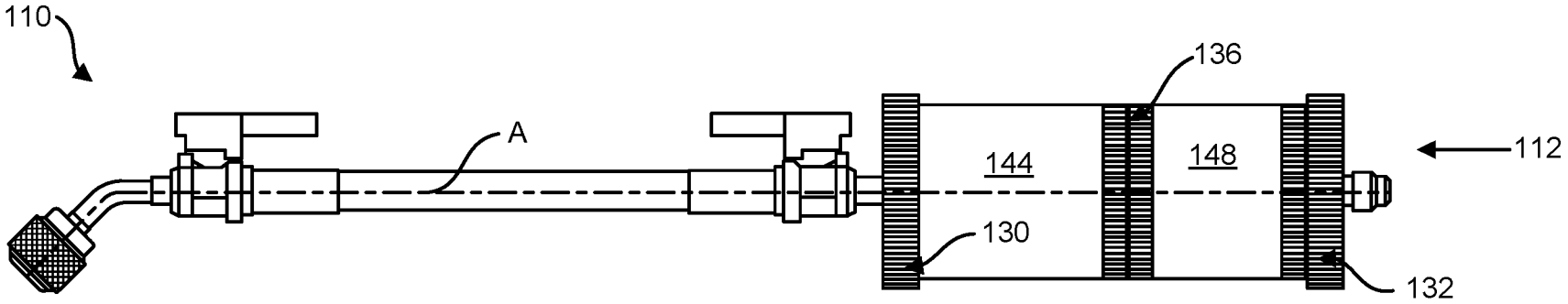
FIG. 8 is an elevation similar to FIG. 6, depicting the reconfigurable container in a second medium-volume fillable container configuration.
Figure 11:
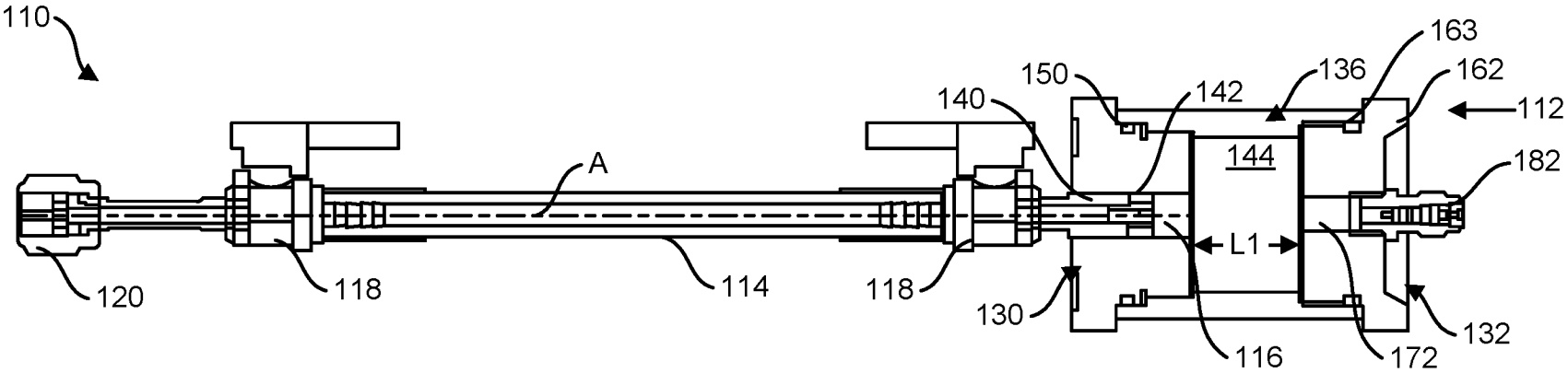
FIG. 11 is a cross-section of an injector, depicting a reconfigurable container thereof in a small-volume fillable container configuration.
Figure 12:
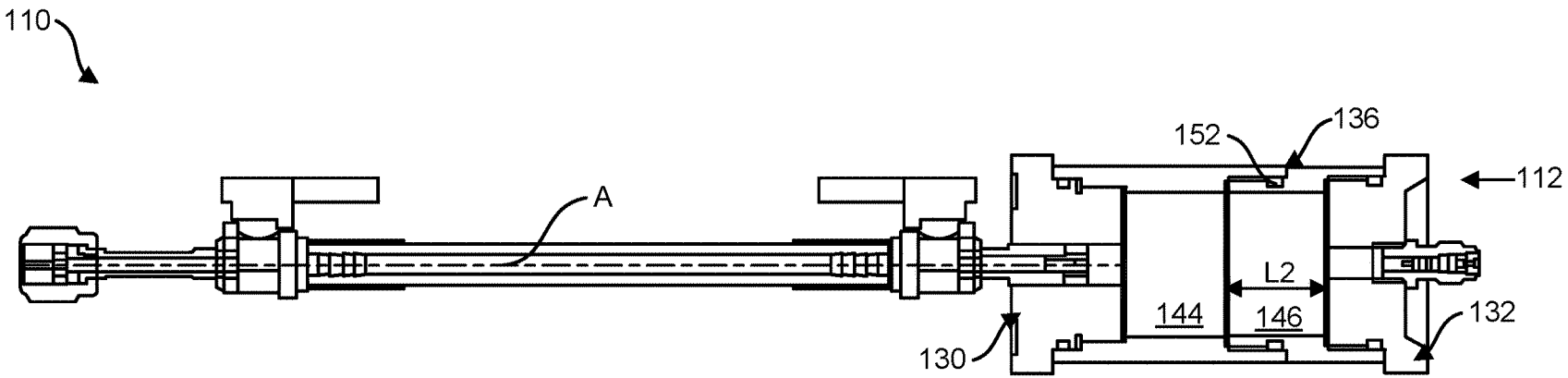
FIG. 12 is a cross-section similar to FIG. 11, depicting the reconfigurable container in a first medium-volume fillable container configuration.
Figure 13:
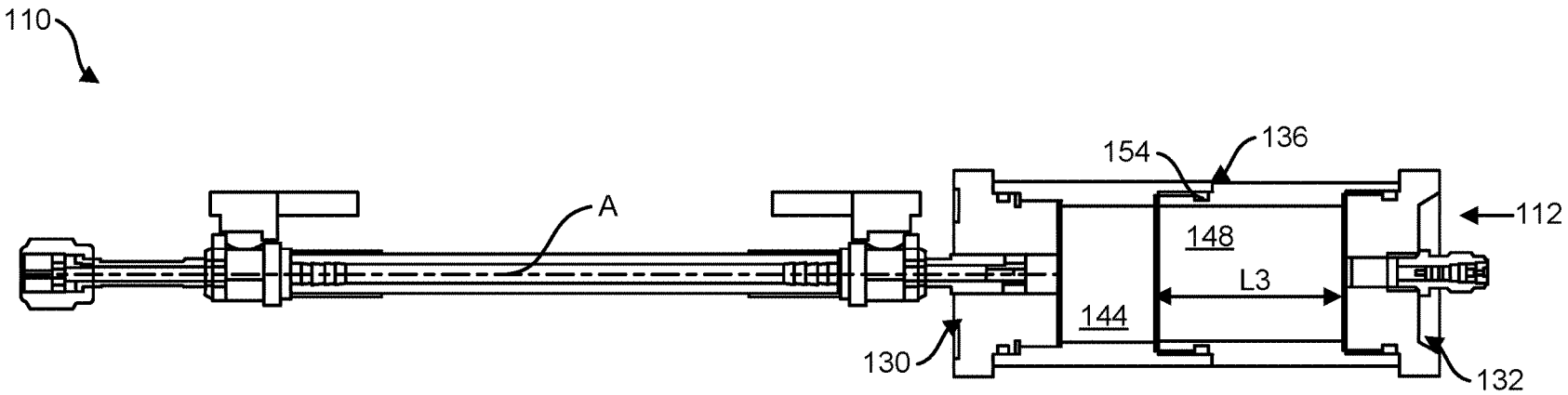
FIG. 13 is a cross-section similar to FIG. 11, depicting the reconfigurable container in a second medium-volume fillable container configuration.

Referring to the drawings, it can be seen that, in the illustrated embodiment, the reconfigurable side wall assembly 136 is selectively configurable in (i) a first configuration in which only the first side wall component 144 extends between and connects the outlet end wall to the inlet end wall (FIGS. 1, 6, 11); (ii) a second configuration in which the first side wall component and the second side wall component 146 are assembled end-to-end to connect the outlet end wall to the inlet end wall (FIGS. 2, 7, 12); (iii) a third configuration in which the first side wall component, the second side wall component, and the third side wall component 148 are assembled end-to-end to connect the outlet end wall to the inlet end wall (FIGS. 4, 9, 14); and (iv) a fourth configuration in which the first side wall component and the third side wall component are assembled end-to-end to connect the outlet end wall to the inlet end wall (FIGS. 3, 8, 13).

The first side wall component 144 has a fillable length L1 (FIG. 11) extending between the inboard ends of the internal threads. (In FIG. 16, the fillable length L1 of the first side wall component 144 extends from the inner (upstream) end of the outlet end wall to the downstream end of the internal threads.) Each of the second and third side wall components 146, 148 has a fillable length L2, L3 (FIGS. 12, 13) that extends from the downstream tip of the respective side wall component to the inboard (downstream) end of the internal threads. The fillable lengths L1, L2, L3 correspond with the fillable volume of each of the side wall components 144, 146, 148. In the illustrated embodiment, the fillable lengths L1, L2 are substantially the same, and thus the fillable volumes of the first and second side wall components 144, 146 are about the same. The fillable length L3 is substantially twice as long as the fillable lengths L1, L2, and thus the fillable volume of the third side wall component 148 is substantially double that of the first and second side wall components 144, 146.

Figure 4:
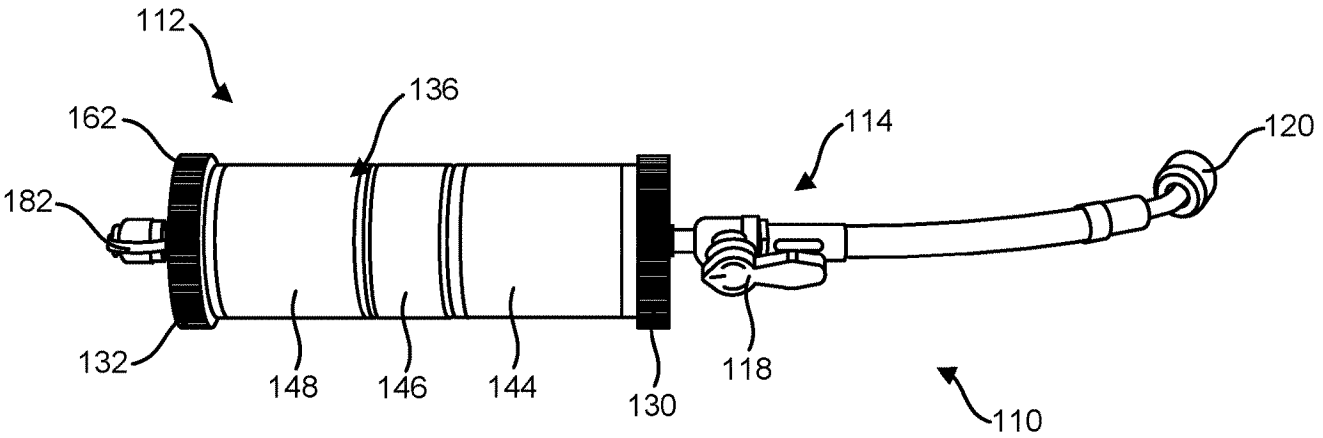
FIG. 4 is an elevation similar to FIG. 1, depicting the reconfigurable container in a large-volume fillable container configuration.
Figure 9:
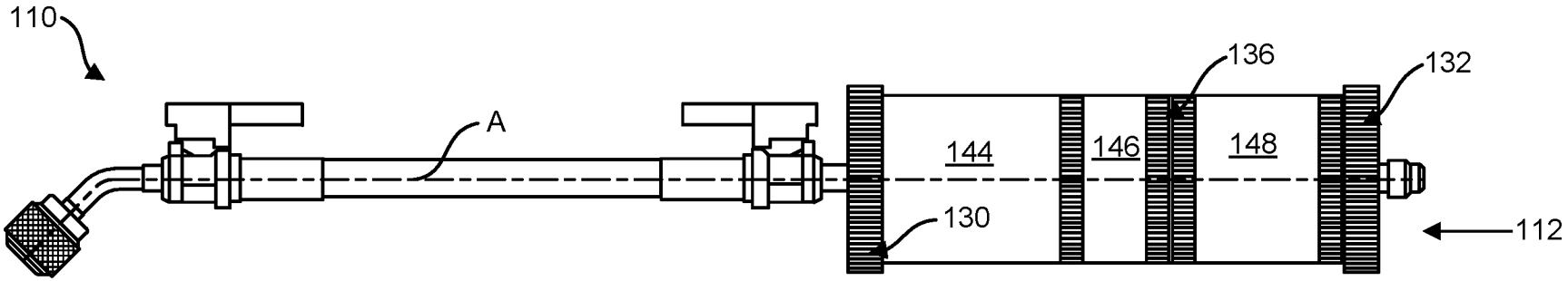
FIG. 9 is an elevation similar to FIG. 6, depicting the reconfigurable container in a large-volume fillable container configuration.
Figure 14:
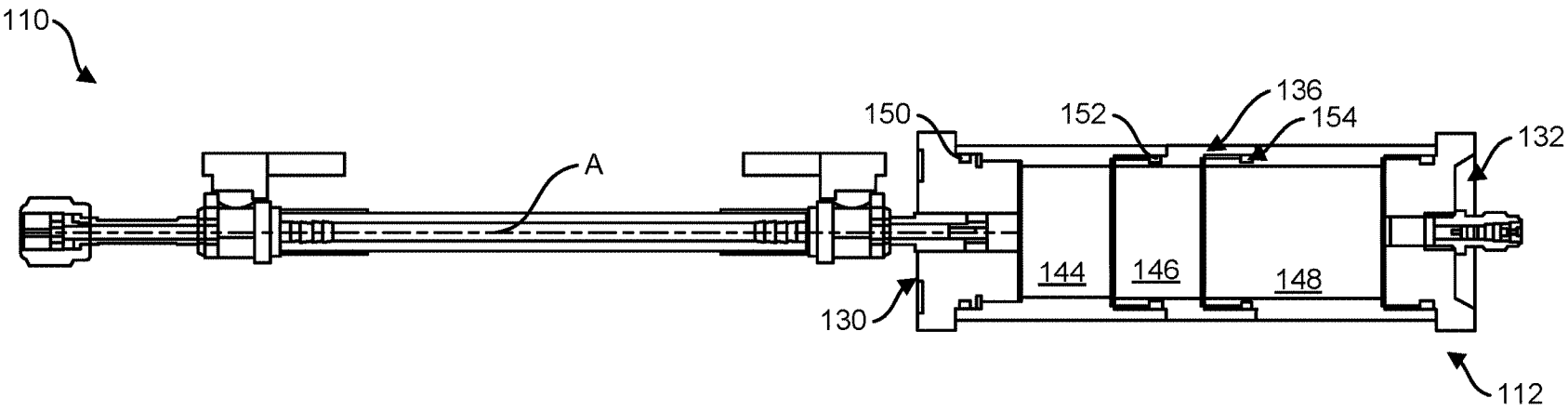
FIG. 14 is a cross-section similar to FIG. 11, depicting the reconfigurable container in a large-volume fillable container configuration.

In one or more embodiments, the lengths L1, L2, L3 are chosen so that each of the side wall components 144, 146, 148 defines a predefined fillable volume in certain configurations of the reconfigurable container. For example, in exemplary embodiments, the lengths L1, L2, L3 define fillable volumes—either alone or in combination with the fillable volumes of the other one(s) of the side wall components 144, 146, 148—that are substantially equal to known volumes of treatment fluid used in refrigeration servicing applications in the art. For example, in the illustrated embodiment, the fillable volumes of the first and second side wall components 144, 146 are substantially equal to 1 ounce and the fillable volume of the third side wall component 148 is substantially equal to 2 ounces. This enables the illustrated reconfigurable container 112 to be selectively configured in four fillable container configurations of different fillable volumes: (1) a i-ounce fillable container configuration (broadly, a small-volume fillable container configuration) when only the first side wall component 144 connects the outlet wall component 130 to the inlet wall component 132 (FIGS. 1, 6, 11); (2) a two-ounce fillable container configuration (broadly, a medium-volume fillable container configuration) when the first and second side wall components 144, 146 are assembled to connect the outlet wall component 130 to the inlet wall component 132 (FIGS. 2, 7, 12); (3) a three-ounce fillable container configuration (broadly, another medium-volume fillable container configuration) when the first and third side wall components 144, 148 are assembled to connect the outlet wall component 130 to the inlet wall component 132 (FIGS. 3, 8, 13); and (4) a four-ounce fillable container configuration (broadly, a large-volume fillable container configuration) when the first, second, and third side wall components 144, 146, 148 are assembled to connect the outlet wall component 130 to the inlet wall component 132 (FIGS. 4, 9, 14).

It will be appreciated that, depending on the service application, the side wall members could have other fillable lengths corresponding to other volumes to produce fillable container configurations of other required volumes. Furthermore, it will be understood that reconfigurable containers may have other numbers of side wall components (e.g., two or more side wall components) so that the reconfigurable container can have other numbers of fillable container configurations.

In an exemplary embodiment, a marking (e.g., an adhesive label bearing the marking) is applied to the exterior of each of the side wall components 144, 146, 148 to indicate the fillable volume of the respective side wall component (see FIGS. 1-5). This enables a service technician to quickly assemble the reconfigurable container 112 in the fillable configuration corresponding to the volume of fluid required for the servicing application.

Figure 5:
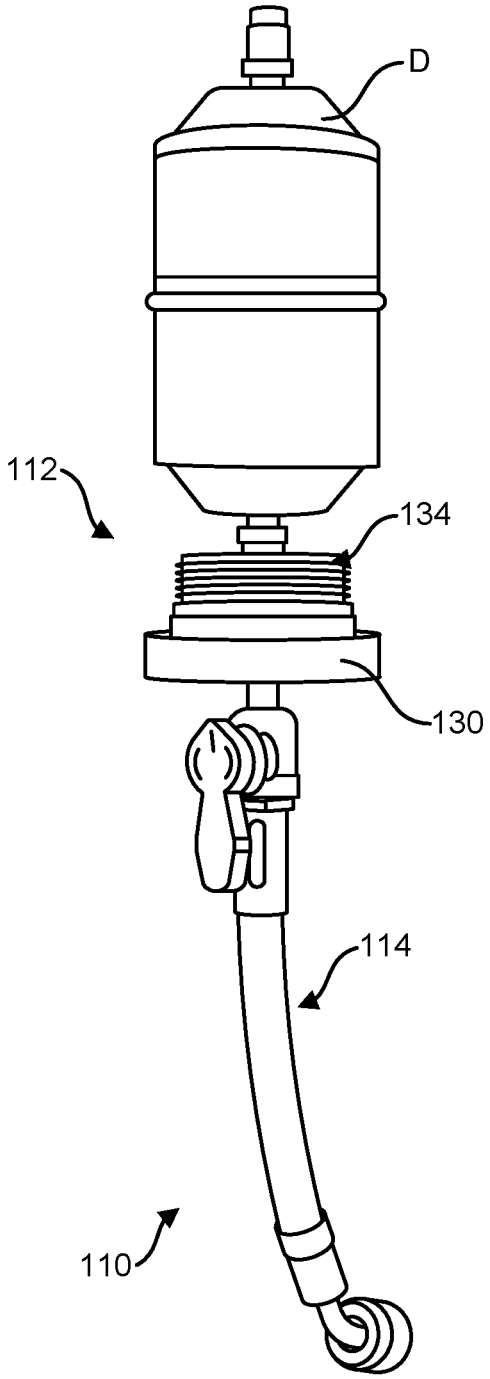
FIG. 5 is an elevation similar to FIG. 1, depicting the reconfigurable container in a pass-through container configuration.
Figure 10:
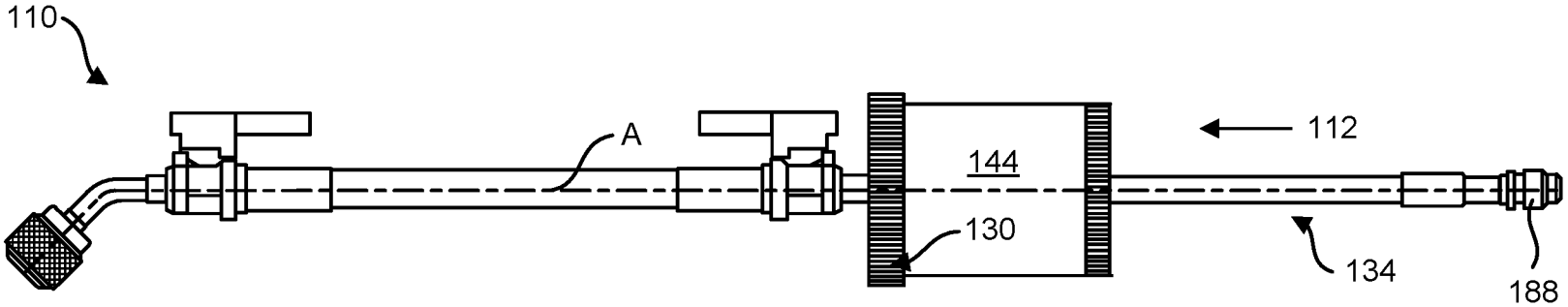
FIG. 10 is an elevation similar to FIG. 6, depicting the reconfigurable container in a pass-through container configuration.
Figure 15:
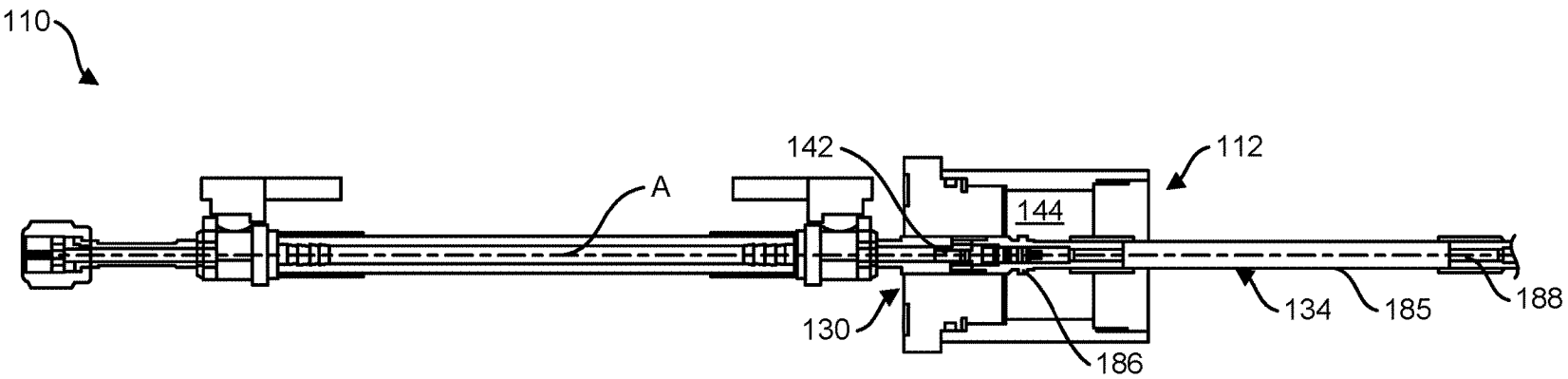
FIG. 15 is a cross-section similar to FIG. 11, depicting the reconfigurable container in a pass-through container configuration.
Figure 16:
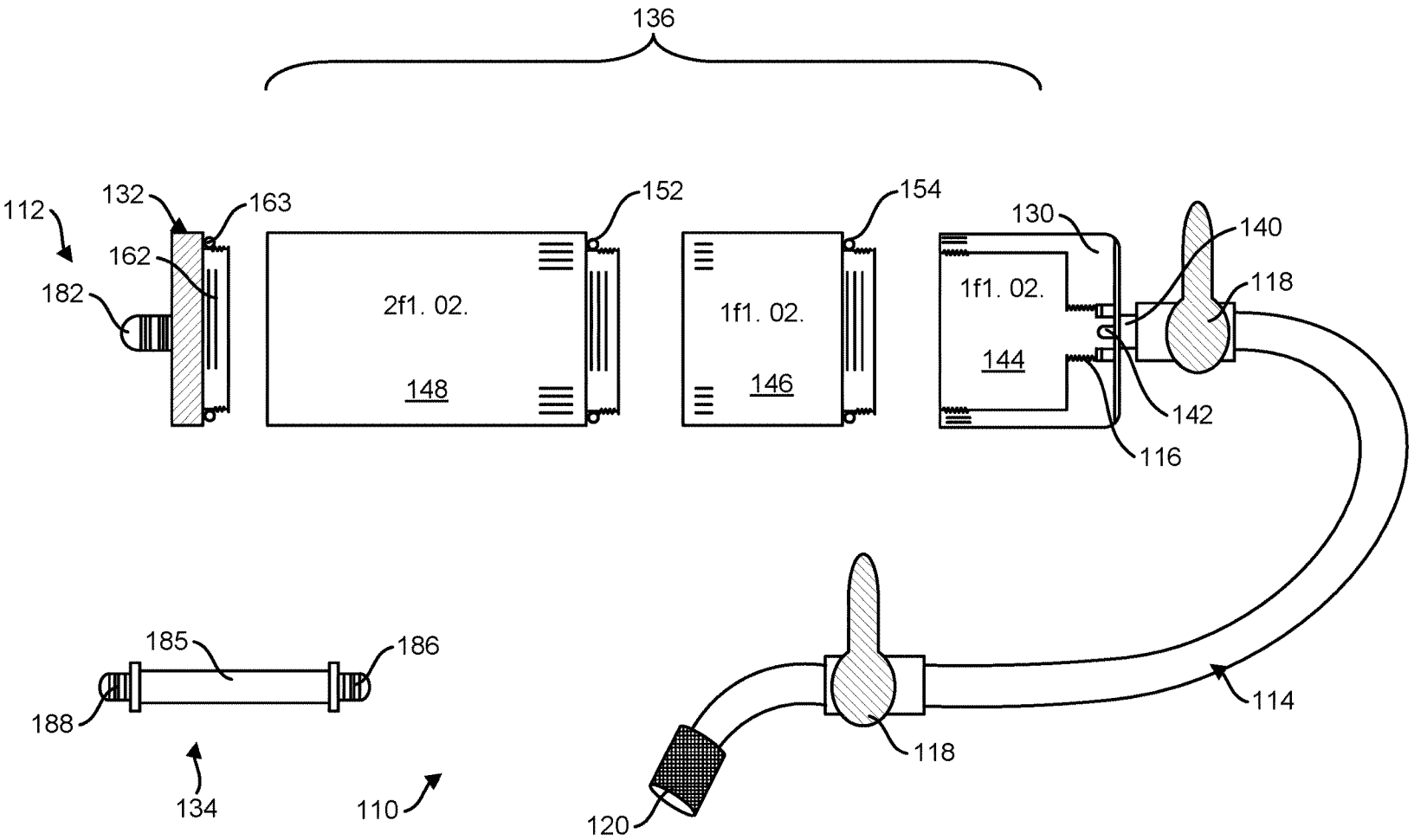
FIG. 16 is an exploded view of an injector system.

The interchangeable inlet components 132, 134 are configured for selectively adjusting the reconfigurable container 112 between fillable container configurations (FIGS. 1-4, 6-9, 11-14) and a pass-through container configuration (FIGS. 5, 10, 15). In the illustrated embodiment, the inlet component 132 is an inlet wall component configured to enclose the upstream end of the container 112 when the container is in any fillable container configuration. By contrast, the inlet component 134 is an inlet coupling component configured to provide pass-through fluid communication between the container outlet 116 and another container D (FIG. 5).

The inlet wall component 132 comprises a respective wall member 162 having an outer (upstream) end and an inner (downstream) end spaced apart along the axis A. The inlet end wall member 162 defines an opening 172 that extends through the wall member along the axis A from the outer end through the inner end. The wall member 162 is configured to releasably connect to the upstream end portion of any of the side wall members 144, 146, 148. In particular, the inner end portion of the wall member 162 is externally threaded for being threaded into the upstream end portion of any of the side wall members 144, 146, 148. The inlet wall component 132 further comprises an exterior seal 163 (e.g., an O-ring gasket) spaced apart along the axis A from the external threads of the inlet wall member 162. The seal 163, is configured to be radially compressed between the inlet wall member 162 and the respective one of the side wall components 144, 146, 148 into which it the inlet wall member is threaded, thereby forming a fluid seal of the threaded connection. Thus, the inlet wall component 132 can be used to seal closed the fillable volume of the container 112 after the container has been filled with fluid. This enables the reconfigurable container 112 to be used as a fillable container for an injector. For example, before installing the inlet wall component 132, treatment fluid is poured into the reconfigurable container 112 to fill the fillable volume of the respective side wall component(s) 144, 146, 148 that are attached to the outlet wall component 130. Once the refillable container 112 is filled with the proper volume of treatment fluid, the inlet wall component 132 is attached to seal closed the internal volume of the fillable container.

The inlet wall component 132 comprises a fluid fitting 182 (e.g., a Schrader fitting) partially received in the opening 172 and configured to fluidly connect the reconfigurable container 112 to a high pressure side of a refrigerant system. The fluid fitting 182 has an inner (downstream) end that is spaced apart from the outlet wall component 130 when the inlet wall component 132 is attached in any fillable configuration of the reconfigurable container 112. The fluid fitting 182 enables liquid from the high pressure side of a refrigerant system to impel the treatment fluid in the fillable container 112 to flow through the outlet hose 114 into the low pressure side of the refrigerant system. Thus, it can be seen that the inlet wall component 132 enables the reconfigurable container to have various refillable configurations. That is, the inlet wall component 132 comprises a fitting 182 configured to communicate directly with the interior of the container in a fillable configuration to enable injecting a fluid held in the container into a refrigerant system.

In contrast, the inlet coupling component 134 configures the reconfigurable container 112 in a pass-through container configuration. More particularly, the inlet coupling component 134 is configured to fluidly couple a disposable treatment fluid container D to a refrigerant system for directing fluid from the disposable container into the refrigerant system. The inlet coupling component 134 comprises a tube 185 configured to extend along the axis A from a downstream end portion to an upstream end portion. In one or more embodiments, the tube 185 has a length along the axis A ater that enables the tube to protrude in the upstream direction from the upstream end of the first side wall component 144 when the first side wall component remains attached to the outlet end component 130.

The coupling component 134 comprises a first fitting 186 on the downstream end portion of the tube 185. The fitting 186 is configured to fluidly connect the coupling directly to the outlet opening 116 of the reconfigurable container 112. For example, the illustrated fitting 186 comprises a male Scrhader fitting that is externally threaded for being threadably received in the upstream end portion of the outlet opening 116. When the Schrader fitting 186 is threadably connected to the outlet opening 116, the depressor 142 depresses the valve stem (broadly, valve member) of the Scharder fitting to open it.

The coupling component 134 further comprises a second fitting 188 (e.g., a Schrader fitting) on the upstream end portion of the tube 185. The upstream fitting 188 is configured to fluidly connect the reconfigurable container 112, in the pass-through configuration, to a disposable treatment fluid container D. Such disposable containers D also have an upstream fitting configured to couple to the high pressure side of a refrigerant system. Thus, when the reconfigurable container 112 is used in the pass-through configuration, the high pressure side of the refrigerant system impels the treatment fluid from the disposable container D through the coupling component 134 and further through the outlet hose 114 into the low pressure side of the container. Thus, it can be seen that the inlet coupling component 134 enables the reconfigurable container 112 to have a pass-through configuration in which the reconfigurable container can provide passage of treatment fluid from a disposable container D to a refrigerant system.

An exemplary method of using the injector system 110 will now be briefly described. Initially, the service technician determines the type and amount of treatment fluid that will be required and then configures the container appropriately.

For example, when one ounce, two ounces, three ounces, or four ounces of treatment fluid from a pour-out container is required, the technician configures the reconfigurable container in a respective fillable container configuration. More particularly, the technician configures the reconfigurable side wall assembly 136 in the configuration defining a fillable volume equal to the required amount of fluid for the servicing application. After configuring the side wall assembly 136 thusly, the technician pours the required volume of fluid into the still-open upstream end of the container and then screws on the inlet end wall component 132. Because the configured side wall assembly 136 is manufactured to hold the required amount of fluid required for each servicing application, the filled and closed container is substantially free of head space or ambient air. Thus, it can be seen that the injector system 110 enables a technician to pour in different volumes of treatment fluid without imparting ambient air in such a way that would require the technician to pull a vacuum. After loading fluid into the container 112 in a refillable container configuration as described above, the technician can impart the fluid into the refrigerant system by connecting the outlet hose 114 to the low pressure service fitting, connecting the inlet fitting 182 to the high pressure service fitting (e.g., via a gauge set manifold), and then opening the shutoff valve(s) 118 (and manifold gauge set valves as needed) so that the high pressure side of the refrigerant system drives the fluid out of the container into the low pressure side of the refrigerant system.

When treatment fluid from a disposable container D is required, the technician configures the reconfigurable container 112 in the pass-through configuration depicted in FIGS. 5, 10, and 15. For example, the technician connects the downstream fitting 186 of the coupling 134 to the outlet opening 116 and connects the upstream fitting 188 to the outlet of the disposable container. To inject the fluid from the disposable container D into the refrigerant system, the technician connects the outlet hose 114 to the low pressure service fitting, connects the inlet of the disposable container to the high pressure service fitting (e.g., via a gauge set manifold), and then opens the shutoff valve(s) 118 (and gauge set manifold valves as needed) so that the high pressure side of the refrigerant system drives the fluid out of the container into the low pressure side of the refrigerant system.

As can be seen, the illustrated injector system 110 provides a single reusable tool that can be used to administer multiple different types of chemical refrigeration treatments, including treatments requiring different fluid volumes and treatments requiring fluid from a pour-out source or a disposable container source. The reconfigurable container 112 is able to couple to a refrigerant system in each of its selectable container configurations so that fluid pressure in the refrigerant system drives treatment fluid to flow through the outlet 116 to the refrigerant system. Further, the refillable container is configured to fluidly isolate the refrigerant system from ambient air when coupled to the refrigerant system. In addition, the various Tillable container configurations of the reconfigurable container 112 allow the injector system 110 to inject different volumes of treatment fluid without either (i) using a vacuum pump to evacuate ambient air from the container 112 or (ii) introducing material quantities of ambient air into the refrigerant system. Those skilled in the art will appreciate that the injector system 110 can eliminate the need for a technician to carry multiple injection tools to cover all of the treatment fluid applications that a technician may wish to perform. That is, the technician can carry only the injector system 110 and is still able to conduct many different types of high quality treatment fluid injections.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

What is claimed is:

1. An injector for servicing a refrigerant system, the injector comprising:

a reconfigurable container having an outlet, the reconfigurable container being selectively configurable in either of a first container configuration and a second container configuration different than the first container configuration;

wherein in each of the first container configuration and the second container configuration the outlet of the reconfigurable container is configured to be fluidly connected to the refrigerant system such that the injector can discharge treatment fluid through the outlet into the refrigerant system;

wherein the reconfigurable container comprises an outlet end wall, an inlet end wall, and a side wall extending circumferentially about an axis from the outlet end wall to the inlet end wall;

wherein the side wall comprises a reconfigurable side wall assembly configured to be selectively and detachably assembled between the outlet end wall and the inlet end wall in a plurality of different configurations to define the side wall;

wherein the reconfigurable side wall assembly comprises first, second, and third side wall components, each of the first, second, and third side wall components configured to extend circumferentially about the axis and each of the first, second, and third side wall components having a respective fillable length along the axis;

wherein the first side wall component has a first end portion configured to couple to the outlet end wall and an opposite second end portion configured to threadably and detachably couple to the inlet end wall;

wherein each of the second side wall component and the third side wall component has a respective first end portion and a respective second end portion, wherein the first end portion of each of the second side wall component and the third side wall component is configured to threadably and detachably couple to the second end portion of any of the first side wall component or the second end portion of the other of the of the second side wall component and the third side wall component and wherein the second end portion of each of the second side wall component and the third side wall component is further configured to threadably and detachably couple to the outlet end wall;

wherein the first, second, and third side wall components are selectively configurable in any of first, second, third, and fourth side wall configurations, each of the first, second, third, and fourth side wall configurations defining a different fillable volume, wherein in the first side wall configuration the first end portion of the first side wall component is coupled to the outlet end wall and the second end portion of the first side wall component is threadably and detachably coupled to the inlet end wall;

wherein in the second side wall configuration, the first end portion of the first side wall component is coupled to the outlet end wall, the first end portion of the second side wall component is threadably and detachably coupled to the second end portion of the first side wall component, and the second end portion of the second side wall component is threadably and detachably coupled to the inlet end wall;

wherein in the third side wall configuration, the first end portion of the first side wall component is coupled to the outlet end wall, the first end portion of the third side wall component is threadably and detachably coupled to the second end portion of the first side wall component, and the second end portion of the third side wall component is threadably and detachably coupled to the inlet end wall; and wherein in the fourth side wall configuration, the first end portion of the first side wall component is coupled to the outlet end wall, the first end portion of the second side wall component is threadably and detachably coupled to the second end portion of the first side wall component, the first end portion of the third side wall component is threadably and detachably coupled to the second end portion of the second side wall component, and the second end portion of the third side wall component is threadably and detachably coupled to the inlet end wall.

2. The injector system as set forth in claim 1, wherein in each of the first container configuration and the second container configuration, the reconfigurable container is configured to couple to the refrigerant system such that a fluid pressure of the refrigerant system drives the treatment fluid to flow through the outlet into the refrigerant system.

3. The injector system as set forth in claim 1, wherein in each of the first container configuration and the second container configuration, the reconfigurable container is configured to couple to the refrigerant system such that the treatment fluid is fluidly isolated from ambient air.

4. The injector as set forth in claim 1, wherein the reconfigurable container has a first fillable volume in the first container configuration and a second fillable volume in the second container configuration, the second fillable volume being greater than the first fillable volume.

5. The injector as set forth in claim 4, wherein the reconfigurable container is further selectively configurable in a third container configuration in which the reconfigurable container has a third fillable volume, the third fillable volume being greater than the second fillable volume.

6. The injector as set forth in claim 5, wherein the reconfigurable container is further selectively configurable in a fourth container configuration in which the reconfigurable container has a fourth fillable volume, the fourth fillable volume being greater than the third fillable volume.

7. The injector as set forth in claim 4, wherein the reconfigurable container is further selectively configurable in another container configuration in which the reconfigurable container is configured to enable pass-through of another treatment fluid from another treatment fluid container to the refrigerant system.

8. An injector for servicing a refrigerant system, the injector comprising:

a reconfigurable container having an outlet, the reconfigurable container being selectively configurable in either of a first container configuration and a second container configuration different than the first container configuration;

wherein in each of the first container configuration and the second container configuration the outlet of the reconfigurable container is configured to be fluidly connected to the refrigerant system such that the injector can discharge treatment fluid through the outlet into the refrigerant system;

wherein in the first container configuration, the reconfigurable container is configured to be filled with the treatment fluid to be imparted from the reconfigurable container assembly into the refrigerant system; and wherein in the second container configuration, the reconfigurable container is configured to fluidly couple to another treatment fluid container which holds another treatment fluid and the reconfigurable container is configured such that the fluid held in the other treatment fluid container is passable through the reconfigurable container into the refrigerant system.

9. The injector system as set forth in claim 1, wherein the Tillable lengths of at least two of the plurality of side wall components are different.

10. The injector system as set forth in claim 1, wherein each of the plurality of side wall components comprises an external marking indicating a volume of the fillable length of the respective side wall component.

11. The injector system as set forth in claim 1, wherein the reconfigurable container comprises first and second interchangeable inlet components.

12. The injector as set forth in claim 11, wherein the first inlet component comprises a wall member having an outer end and an opposite inner end, an opening extending through the wall member from the outer end through the inner end, and a fluid fitting at least partially received in the opening and having an inner end configured to be spaced apart from the outlet of the reconfigurable container; and wherein the second inlet component comprises a fluid coupling configured to fluidly couple the outlet of the reconfigurable container to another fluid container.

13. The injector as set forth in claim 12, wherein the fluid coupling comprises a fitting configured to fluidly couple to the outlet, wherein the fitting comprises a normally closed valve, and wherein the reconfigurable container comprises a valve actuator configured to open the normally closed valve when the fitting is fluidly coupled to the outlet.

14. The injector as set forth in claim 8, wherein the reconfigurable container comprises an outlet end wall, an inlet end wall, and a side wall extending circumferentially about an axis from the outlet end wall to the inlet end wall.

15. The injector as set forth in claim 14, wherein the outlet end wall comprises a valve depressor and wherein in the second container configuration, the outlet end wall is configured to couple to said another treatment fluid container such that said another treatment fluid container depresses the valve depressor.

16. The injector as set forth in claim 15, wherein in the second container configuration, the side wall and the inlet end wall are disconnected from the outlet end wall.

17. The injector as set forth in claim 1, wherein the first end portion of the second side wall component and the first end portion of the third side wall component each comprise a compressible gasket configured to form a liquid seal when the first end portion of the respective one if the second side wall component and the first end portion of the third side wall component is threadably and detachably coupled to another component.

* * * * *